United States Patent [19]

Ikeda et al.

[11] Patent Number: 4,551,424

[45] Date of Patent: Nov. 5, 1985

[54] SILVER HALIDE PHOTOGRAPHIC LIGHT-SENSITIVE MATERIAL

[75] Inventors: Tadashi Ikeda; Kenichi Kuwabara; Kiyohiko Yamamuro; Tadayoshi Kokubo, all of Kanagawa, Japan

[73] Assignee: Fuji Photo Film Co., Ltd., Kanagawa, Japan

[21] Appl. No.: 681,757

[22] Filed: Dec. 14, 1984

[30] Foreign Application Priority Data

Dec. 22, 1983 [JP] Japan ..... 58-242716

[51] Int. Cl.[4] ..... G03C 1/02

[52] U.S. Cl. ..... 430/588; 430/429; 430/523; 430/542; 430/546; 430/550; 430/551; 430/576; 430/577; 430/591; 430/631

[58] Field of Search ..... 430/429, 523, 542, 546, 430/550, 551, 576, 577, 588, 591, 631

[56] References Cited

U.S. PATENT DOCUMENTS

| | | | |
|---|---|---|---|
| 2,288,226 | 6/1942 | Carroll et al. | 430/576 |
| 3,481,742 | 12/1969 | Terashima et al. | 430/576 |
| 3,759,713 | 9/1973 | Florens et al. | 430/577 |
| 3,885,970 | 5/1975 | Migahara | 430/581 |
| 4,385,110 | 5/1983 | Yoneyama et al. | 430/546 |
| 4,463,087 | 7/1984 | Maskasky | 430/581 |

*Primary Examiner*—J. Travis Brown

*Attorney, Agent, or Firm*—Sughrue, Mion, Zinn, Macpeak and Seas

[57] ABSTRACT

A silver halide photographic light-sensitive material is described, comprising a support and at least one silver halide emulsion layer on the support, wherein the silver halide emulsion layer contains at least one specific type of sensitizing dye, at least one of the silver halide emulsion layer and other hydrophilic colloid layers contains at least one compound of four specific types of compounds and the silver halide grains contained in the silver halide emulsion are substantially tetradecahedral grains in which the proportion of (100) faces is at least 50%; this material is superior in both sensitivity and stain resistance.

10 Claims, No Drawings

SILVER HALIDE PHOTOGRAPHIC LIGHT-SENSITIVE MATERIAL

FIELD OF THE INVENTION

The present invention relates to a silver halide photographic light-sensitive material. More particularly, it is concerned with a silver halide photographic light-sensitive material which is highly sensitized in the wavelength region of from blue-green to green through spectral sensitization with sensitizing dyes, and which shows low stain after development and is superior in whiteness.

BACKGROUND OF THE INVENTION

Spectral sensitization is a well known and important means for extending the spectral sensitivity of a silver halide photographic emulsion from the inherent sensitivity region of silver halide to a longer wavelength region. It is now possible to control the light-sensitive wavelength region almost at will up to the infrared region, depending on the particular purpose, by appropriately choosing the type or structure of a sensitizing dye. However, there still remain some problems to be overcome. Sensitizing dyes for use in spectral sensitization are required to meet, as well as the original requirements that (1) spectral sensitivity distribution is suitable and (2) high sensitivity can be imparted within the desired spectral sensitization region, the following requirements: (3) they do not cause the formation of fog, (4) they do not cause a change in sensitivity or an increase in fog during the production or storage of the light-sensitive material, (5) they do not stain the light-sensitive material by remaining as is or forming colored substances through decomposition after development.

In spectral sensitization within the region of from blue to green, a number of sensitizing dyes are known to be useful, e.g., monomethinecyanines, apomerocyanines, dimethylmerocyanines, pseudocyanines, carbocyanines, hemicyanines, etc. Photographic systems in which the above sensitizing dyes can be used include a facsimile system to send a draft of newspaper to a distant place, a high speed photographic-composing system to prepare a printing form very rapidly, a cathode ray tube display system in which an output from an electronic calculator is displayed and recorded as a figure or character by the use of a cathode ray tube, a microfilm system for duplication, and a lith film system using a light-sensitive material for photomechanical use. In addition, they are used in various silver halide light-sensitive materials such as a microfilm for duplication, a lith film as a light-sensitive material for photo-mechanical use, a light-sensitive material for X-ray use, a multilayer color light-sensitive material, a black-and-white light-sensitive material for lens through camera, and a black-and-white photographic paper. In connection with spectral sensitization, which is essential in preparation of the silver halide light-sensitive materials as described above, various improvements have been described, for example, in Japanese Patent Application (OPI) Nos. 106423/76, 73137/73, 106426/76, 139323/76, 140622/76 (the term "OPI" as used herein refers to a "published unexamined Japanese patent application"), Japanese Patent Publication Nos. 12656/74 and 13021/74.

Various types of light sources which are used in the above-described systems include a xenon flash light, a flying spot of a fluorescent substance of a cathode ray tube, a laser light, a xenon arc light, a high pressure mercury lamp, a luminescent semiconductor diode, a glow discharge tube, a tungsten light, and a sunlight. Even in the same system, a single light source is not always used; in some cases, a plurality of light sources are used. Thus, even in the case of a light-sensitive material to be used in a single system, it is required to exhibit high sensitivity to all light sources. In the cathode ray tube display system, for example, many fluorescent substances, such as P-1, P-11, P-15, P-16, P-22, P-22D, P-24, P-31 (which each shows a code number of the cathode ray tube display, for example, P-11 shows a cathode ray tube display comprising a fluorescent substance which has an emission peak of 470 nm generally used for photography), are used and their emission intensity distributions are different. In the photocomposing system, as well as a cathode ray tube display, a xenon flash light and a tungsten light, for example, are used. Furthermore, as well as they have different emission intensity distributions, their emission energy intensities are greatly different. Thus, it is required for silver halide photographic light-sensitive materials for use in the above photographic systems to exhibit high sensitivity to all light sources which might be used therewith.

Although it is very difficult to meet even the above requirement alone, the light-sensitive material should satisfy the above-described requirements (1) to (5) to the greatest extent possible. That is, only a light-sensitive material meeting all the above requirements is commercially usable. In particular, in a reflection type light-sensitive material, the stain or fog is conspicuous compared with a transmission type light-sensitive material. In the case of the reflection type light-sensitive material, even an improvement in whiteness alone has not been disclosed. With the spread of rapid developing systems using an automatic developing machine, stain has recently become a conspicuous problem, although it has not been formed in the conventional technique. This problem cannot be explained as being simply because of the sensitizing dye remaining due to a reduction in the processing time; rather, it is ascribable to a reduction in the drying time and hardening of coated layers of emulsions, for example, so that the light-sensitive material can be passed at high speeds in the automatic developing machine, and by this reason the sensitizing dye may more readily remain in the light-sensitive material after development. If the sensitizing dye remains, not only is the stain increased, but also the development is inhibited. Thus, it is required for the light-sensitive material to have higher sensitivity. Under these circumstances, it has been desired to develop a spectral sensitization technique which permits the production of improved silver halide photographic light-sensitive materials.

SUMMARY OF THE INVENTION

An object of the present invention is to provide a silver halide photographic emulsion which has high sensitivity in the wavelength region of from blue to green through spectral sensitization; in particular, a silver halide photographic emulsion which has high sensitivity to exposure using various types of light sources, such as a tungsten light source, a xenon light source, a laser light source, and a flying spot light source of a fluorescent substance of a cathode ray tube, having an emission distribution in the above wavelength region.

Another object of the present invention is to provide a silver halide photographic emulsion which causes less stain and also a silver halide photographic emulsion which causes less stain of the light-sensitive material even if used in an automatic developing system, a hardening system, or a combination thereof, in which the light-sensitive material tends to be readily stained.

Still another object of the present invention is to provide a light-sensitive material with a reflection support (e.g., a paper support on which a polyolefin, such as polyethylene, is laminated, and a film support in which a white pigment is compounded), which has a superior whiteness and is impermeable to water even in the above processing.

A further object of the present invention is to provide a silver halide photographic light-sensitive material which has high sensitivity even in exposure under conditions of high illumination and short time (about not more than 1/1,000 second, and particularly not more than 1/10,000 second).

A still further object of the present invention is to provide a silver halide photographic emulsion which is substantially free of changes in sensitivity, including spectral sensitivity distribution, during the preparation of the emulsion and also during the preparation of a light-sensitive material or storage thereof after preparation, and which is further free from undesirable phenomena such as the formation of fog.

It has now been found that if spectral sensitization is carried out by applying a combination of a sensitizing dye having a specific structure and a specific surface active agent to a silver halide emulsion having a specific crystalline phase, photographic properties can be obtained which are much superior to properties obtained by conventional spectral sensitization, and, furthermore, that a reflection type light-sensitive material having a superior whiteness can be obtained.

More particularly, it has been found that the objects are attained by using at least one sensitizing dye which is represented by formula (I) as described hereinafter, at least one surface active agent which is represented by formula (II), (III), (IV) or (V) as described hereinafter, and silver halide grains which are substantially tetradecahedral grains the proportion of (100) faces of which is at least 50%.

Particularly, the present invention is directed to a silver halide photographic light-sensitive material comprising a support and at least one silver halide emulsion layer on the support, containing at least one sensitizing dye represented by formula (I)

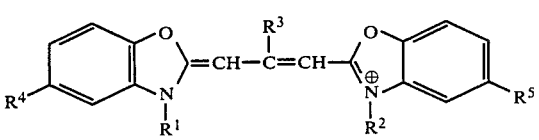

(I)

wherein $R^1$ and $R^2$ each represents a lower alkyl group (preferably having 4 or less carbon atoms) substituted by a sulfo group, a carboxyl group, or a hydroxyl group, provided that at least one of $R^1$ and $R^2$ represents a sulfoalkyl group; $R^3$ represents hydrogen, a lower alkyl group (preferably having 5 or less carbon atoms), or a phenethyl group, which may be substituted by groups such as a fluorine atom, a chlorine atom, a methyl group, an ethyl group, a methoxy group, and a hydroxyl group; $R^4$ represents a chlorine atom, a methoxy group, an ethoxy group, or a hydrogen atom; and $R^5$ represents a chlorine atom, a phenyl group, a lower alkoxyl group (having 4 or less carbon atoms), or a lower alkyl group (having 4 or less carbon atoms);

wherein at least one of the silver halide emulsion layer and other hydrophilic colloid layers contains at least one surface active agent represented by formula (II), (III), (IV) or (V)

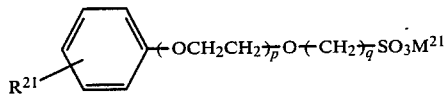

(II)

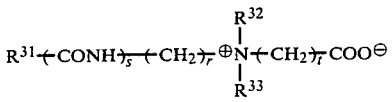

(III)

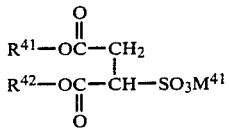

(IV)

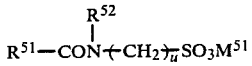

(V)

wherein $R^{21}$ represents an alkyl or alkenyl group having from 4 to 16 carbon atoms (preferably from 5 to 12 carbon atoms); $R^{31}$ represents an alkyl or alkenyl group having from 5 to 17 carbon atoms (preferably from 5 to 11 carbon atoms); $R^{32}$ and $R^{33}$ (which may be the same or different) each represents an alkyl group having 4 or less carbon atoms, or a hydroxyalkyl group, provided that the total number of carbon atoms of $R^{32}$ and $R^{33}$ is 5 or less; $R^{41}$ and $R^{42}$ (which may be the same or different) each represents an alkyl or alkenyl group having from 4 to 12 carbon atoms, provided that the total number of carbon atoms of $R^{41}$ and $R^{42}$ is 18 or less (preferably from 10 to 14 carbon atoms); $R^{51}$ represents an alkyl or alkenyl group having from 5 to 17 carbon atoms (preferably 13 or less carbon atoms); $R^{52}$ represents a methyl group, an ethyl group, or a propyl group; p is an integer of from 1 to 11 (preferably from 1 to 8); q is 2, 3, or 4; r is an integer of from 2 to 8 (preferably from 2 to 5); s is 0 or 1; t is 1, 2, or 3; u is 2, 3, or 4; and $M^{21}$, $M^{41}$ and $M^{51}$ (which may be the same or different) each represents a hydrogen atom or an alkali metal atom (e.g., Na and K);

and the silver halide grains in the silver halide emulsion are substantially tetradecahedral grains in which the proportion of (100) faces is at least 50%.

DETAILED DESCRIPTION OF THE INVENTION

Particularly preferred in the sensitizing dyes of formula (I) are those in which $R^1$ and $R^2$ both represent sulfoalkyl groups having from 2 to 4 carbon atoms wherein the alkylene portion may be further substituted by a methyl group, a chloro group, or a hydroxyl group (e.g., 2-sulfoethyl, 3-sulfopropyl, 4-sulfobutyl, 3-methyl-3-sulfopropyl, 2-chloro-3-sulfopropyl, and 2-hydroxy-3-sulfopropyl); $R^3$ represents a methyl group, an ethyl group, or a propyl group; $R^4$ represents a methoxy group, an ethoxy group, or a chlorine atom; and $R^5$ represents a chlorine atom, a phenyl group, a methoxy group, or an ethoxy group (preferably $R^4$ represents a methoxy group or a chlorine atom, and $R^5$ represents a chlorine atom, a methoxy group, or an ethoxy group).

Representative examples of the sensitizing dyes of formula (I) are shown below, although the present invention is not limited thereto.

(I-1)

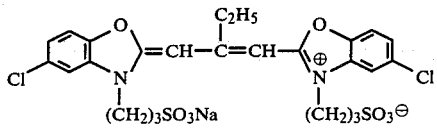

(I-2)

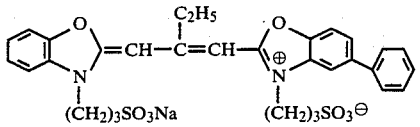

(I-3)

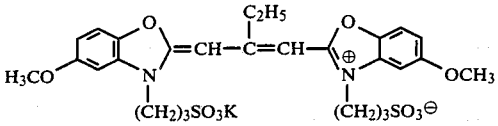

(I-4)

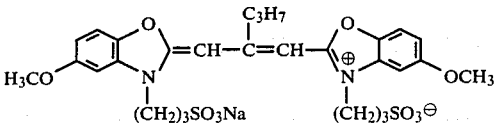

(I-5)

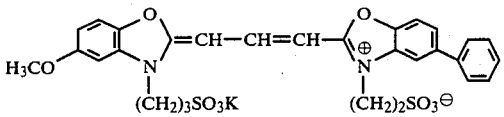

(I-6)

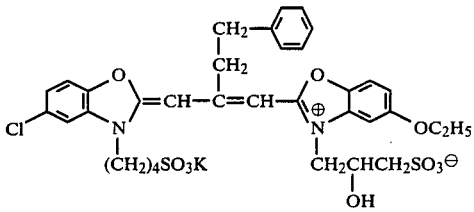

(I-7)

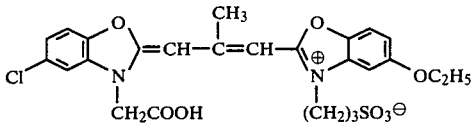

(I-8)

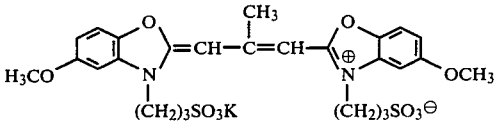

(I-9)

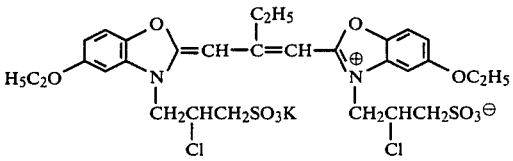

-continued (I-10)

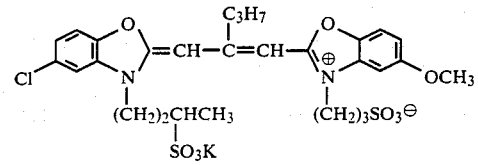

(I-11)

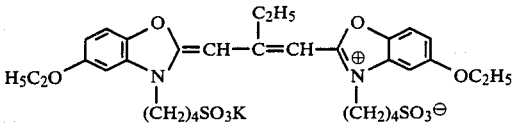

(I-12)

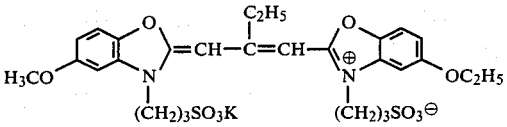

(I-13)

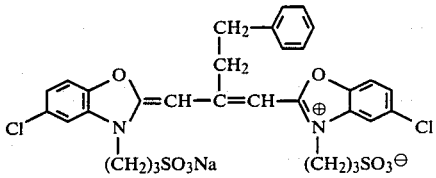

The sensitizing dyes which are represented by formula (I) are known compounds and can be prepared by reference to, for example, Japanese Patent Application (OPI) No. 104917/77; Japanese Patent Publication Nos. 22884/68, 25652/73, and 22368/82; F. M. Hamer, *The Chemistry of Heterocyclic Compounds,* Vol. 18 (i.e., A. Weissberger ed., The Cyanine Dyes and Related Compounds), Interscience, New York (1964); D. M. Sturmer, *The Chemistry of Heterocyclic Compounds,* Vol. 30, A. Weissberger & E. C. Taylor, eds., John Willey, New York, page 441 (1977).

The sensitizing dyes of formula (I) may be dispersed directly in a silver halide emulsion, or they may be first dissolved in one or more of solvents such as water, methanol, ethanol, propanol, methyl Cellosolve, 2,2,3,3-tetrafluoropropanol, etc., and then added to the emulsion. In addition, a procedure as described, for example, in Japanese Patent Publication Nos. 23389/69, 27555/69 and 22089/82 in which the dyes are dissolved in water in the presence of acids or bases to prepare the corresponding aqueous solutions which are then added to the emulsion, and a procedure as described, for example, in U.S. Pat. Nos. 3,822,135 and 4,006,025 in which the dyes are converted into aqueous solutions or colloidal dispersions by the use of the surface active agents represented by formula (II) and then added to the emulsion can also be employed. A procedure may also be employed in which the dyes are dissolved in solvents substantially immiscible with water (e.g., phenoxyethanol) and then dispersed in water or hydrophilic colloids and, thereafter, added to the emulsion. A procedure as described in Japanese Patent Application (OPI) Nos. 102733/78 and 105141/83 may be employed in which the dyes are dispersed directly in hydrophilic colloids and the resulting dispersions are added to the emulsion. The sensitizing dyes are usually added to the emulsion before it is coated on a suitable support. In addition, they may be added during the chemical ripening or the formation of silver halide grains; for example, as described in Japanese Patent Application (OPI) No. 26589/80, they may be added during the formation of silver halide grains.

The sensitizing dye of formula (I) can be used in amounts of from about $2\times10^{-6}$ to $8\times10^{-3}$ mol per mol of silver halide in the silver halide emulsion. For instance, in the case wherein the silver halide grain size is from 0.5 to 1.2 μm, the amount of the sensitizing dye added is desirably from $5\times10^{-5}$ to $2\times10^{-3}$ mol per mol of silver halide.

The amount of the silver halide emulsion coated is preferably 2.0 g/m$^2$ or less, calculated as silver. The amount of hydrophilic colloid gels such as gelatin to be used for the purpose of dispersing silver halide grains therein or forming a protective layer is preferably 8.0 g/m$^2$ or less.

As silver halide to be used in the present invention, any of silver bromide, silver iodobromide, silver chloroiodobromide, silver chlorobromide, silver chloride, and so forth can be used. Silver iodobromide and silver chloroiodobromide each containing not more than 5 mol% of silver iodide, or silver bromide is preferably used. Particularly preferred are silver iodobromide and silver chloroiodobromide each containing from 0.2 to 3.5 mol% of silver iodide.

The proportion of (100) faces in silver halide grains as used herein is preferably from 50 to 95%.

The proportion of (100) faces in the silver halide grains can be readily determined by known methods, such as a method utilizing an electron microscope and a dye adsorption method, as described in Bull, *Chemical Soci. of Japan,* (4), pp. 942-947 (1984). According to the dye adsorption method, proportion of the area of (100) face to the total surface area of fine silver grains in photographic emulsions is determined on the basis of difference in absorption spectrum between a dye adsorbed on (100) face and that adsorbed on (111) face of the grains. Namely, the reflection spectra of thick liquid emulsion layer containing various amounts of a cyanine dye, i.e., 3,3'-bis(4-sulfobutyl)-9-methylthiacarbocyanine which showed a double band with the absorption maxima at 600 and 525 nm on the (100) face and J band with the absorption maximum at 630 nm on the (111) face were treated by the Kubelka-Munk equation to give saturated amounts of the dye adsorbed to (100) and (111) faces of the grains. Thus, the proportion of (100) face was determined for each emulsion with an error of 10%.

Silver halide grains may be composed of an inner portion or core and a surface layer or shell, which are different from each other in composition, or the composition may be uniform through the whole silver halide grain. The average grain size is not critical in the present invention; it is preferably 3 μm or less, and particularly preferably from 0.5 to 1.2 μm. The average grain size is an average value of grain sizes as determined based on projected areas with an edge length (a long side length) as a grain size for nearly cubic grains, or, in the case of other grains, with a diameter of a sphere having almost similar projected area to a certain grain as a grain size. The grain size distribution may be broad or narrow; it is preferred for the grain size distribution to be narrow.

In the process of formation or physical ripening of the silver halide grains, salts of Group VIII metals of the Periodic Table (such as rhodium salts, iridium salts and iron salts), cadmium salts, zinc salts, lead salts, and so forth as described in Japanese Patent Publication No. 56056/82, Japanese Patent Application (OPI) No. 73137/73 and Japanese Patent Publication No. 32738/70, which are effective in increasing high illumination suitability, may be allowed to coexist.

The compounds of formulae (II) to (V) are generally called surface active agents. It is known that in silver halide emulsion layers and other hydrophilic colloid layers of light-sensitive materials, a variety of surface active agents can be used as coating aids or for various other purposes, e.g., preventing charging, improving sliding properties, accelerating emulsification and dispersion, preventing adhesion, or improving photographic characteristics (e.g., acceleration of development, increasing high contrast, and sensitization).

Many surface active agents, however, remarkably exert adverse influences on the light-sensitive material with respect to sensitivity and stain. However, now, as a result of extensive investigations, it has been found that the objects of the present invention are attained by using the compounds of formulae (II) to (V) in combination with the above silver halide emulsion in which the sensitizing dyes of formula (I) are incorporated and the proportion of (100) faces of silver halide grains is at least 50%. Therefore, in a case that certain surface active agents are used in the emulsion layer or hydrophilic colloid layer existing on the same side as the emulsion layer for the above-described purposes, it is preferred that the compounds of formulae (II) to (V) be used as the surface active agents. When surface active agents other than the compounds of formulae (II) to (V) are used, it is naturally preferred that they be added in a minimum amount capable of achieving the particular purpose for which they are used.

The compounds of formulae (II) to (V) are known compounds and can be prepared by reference to, for example, Japanese Patent Publication No. 8401/69; U.S. Pat. Nos. 2,739,891, 3,026,202 and 3,502,473; Japanese Patent Application (OPI) Nos. 43924/73, 79185/71 and 46133/75; R. Oda et al., *Kaimen Kassei Zai no Gosei to sono Oyo,* Maki Shoten, Tokyo (1964): A. W. Perry, *Surface Active Agents,* Interscience (1958); and J. P. Shisley, *Encyclopedia of Active Agents,* Chemical Publish, Vol. 2 (1964).

The amount of the compounds which are represented by formulae (II) to (V) used in the present invention is $1\times10^{-6}$ to $1\times10^{-1}$ mol per mol of Ag.

Representative examples of the compounds of formulae (II) to (V) are shown below.

(II-1)

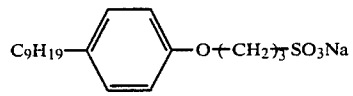

(II-2)

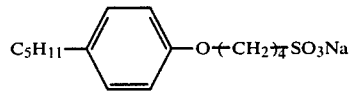

(II-3)

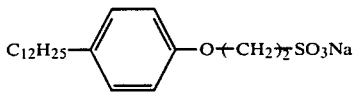

-continued
(II-4)
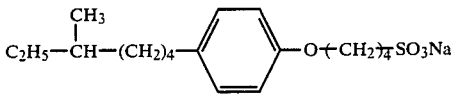
(II-5)
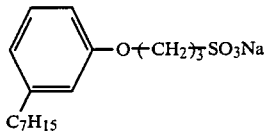
(II-6)
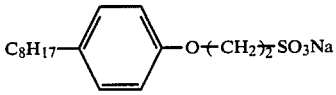
(II-7)
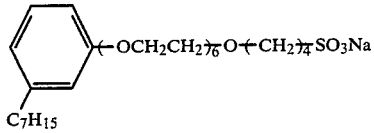
(II-8)
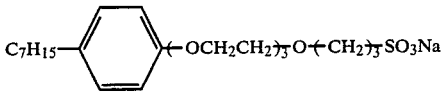
(II-9)
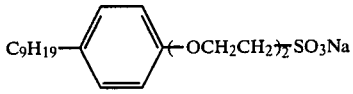
(II-10)
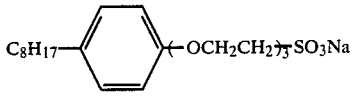
(II-11)
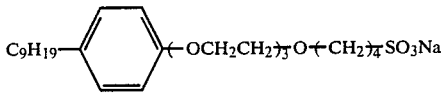
(II-12)
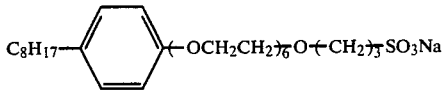
(II-13)
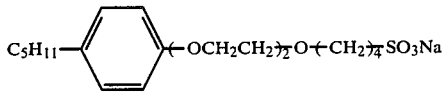
(II-14)
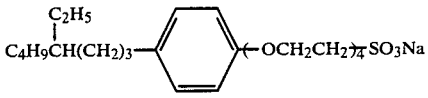
(II-15)
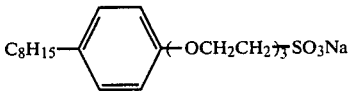
(III-1)
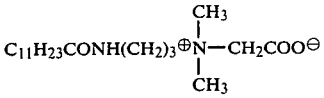
-continued
(III-2)
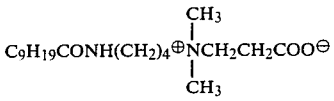
(III-3)
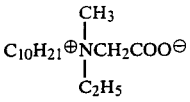
(III-4)
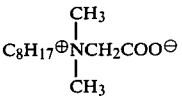
(III-5)
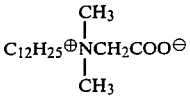
(III-6)
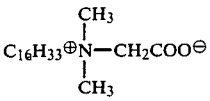
(III-7)
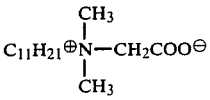
(IV-1)
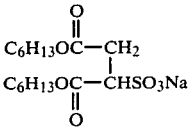
(IV-2)
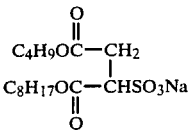
(IV-3)
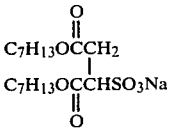
(IV-4)
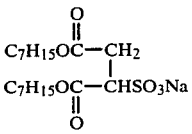
(IV-5)
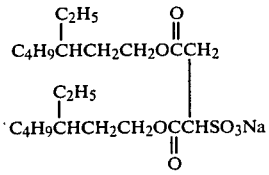
(V-1)
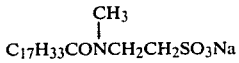
(V-2)
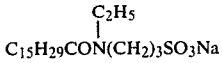

-continued $$C_{15}H_{31}CON(CH_3)CH_2CH_2SO_3Na \quad (V\text{-}3)$$

$$C_{10}H_{21}CON(CH_3)(CH_2)_4SO_3Na \quad (V\text{-}4)$$

$$C_9H_{19}CON(CH_3)CH_2CH_2SO_3Na \quad (V\text{-}5)$$

$$C_{11}H_{23}CON(CH_3)(CH_2)_3SO_3Na \quad (V\text{-}6)$$

$$C_8H_{17}CON(C_2H_5)(CH_2)_3SO_3Na \quad (V\text{-}7)$$

The compounds of formulae (II) to (V) are very effective in achieving the objects of the present invention as illustrated in the examples as described hereinafter. In order to increase sensitivity without the extension of the spectral sensitivity distribution to a longer wavelength region (necessary for maintaining safe-light stability, for example), it is very effective to use the sensitizing dyes as described below in combination with the sensitizing dye represented by formula (I). This method does not at all deteriorate the stain, and provides increased sensitivity at high illumination exposure.

That is, if at least one of the sensitizing dyes of formulae (VI) and (VII) described below is used in combination with the sensitizing dye represented by formula (I), the spectral sensitivity in the region of from 450 to 500 nm can be increased without causing any reduction in sensitivity in other spectral sensitivity regions.

(VI)

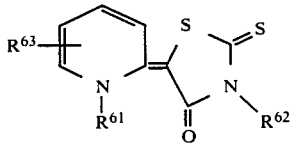

(VII)

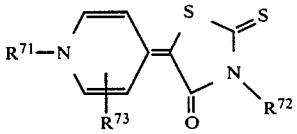

In formulae (VI) and (VII), $R^{61}$ and $R^{71}$ each represents an alkyl group or an alkenyl group, having 6 or less carbon atoms, or a sulfoalkyl group (wherein the alkylene portion preferably contains from 2 to 4 carbon atoms); the alkylene portion may be substituted by, e.g., a chlorine atom, a hydroxyl group, a methyl group, an ethyl group, and a methoxy group, and the sulfo group may be in the form of an alkyl metal (e.g., sodium, potassium) salt or ammonium salt (e.g., a triethylammonium salt and a pyridinium salt). Representative examples of the groups represented by $R^{61}$ and $R^{71}$ include methyl, ethyl, propyl, butyl, 2-sulfoethyl, 3-sulfopropyl, 4-sulfobutyl, 3-methyl-3-sulfopropyl, 2-hydroxy-3-sulfopropyl, 2-methoxy-3-sulfopropyl and 2-chloro-3-sulfopropyl.

$R^{62}$ and $R^{72}$ each represents a lower alkyl group or a lower alkenyl group (both preferably having 10 or less carbon atoms and particularly preferably 6 or less carbon atoms), and may be substituted by a phenyl group (which may be further substituted, for example, by a methoxy group, a methyl group, a chlorine atom, a fluorine atom, a carboxyl group, and a hydroxyl group), a monocyclic hetero ring (e.g., pyridyl, furyl, thienyl, tetrahydrofuryl, tetrahydrothienyl, 1,3-dioxane-2-yl, and pyranyl), a lower alkoxy group (e.g., a methoxy group, an ethoxy group, and a butoxy group), a carboxy group, an alkoxycarbonyl group (e.g., a methoxycarbonyl group and an ethoxycarbonyl group), a hydroxyl group, a hydroxyalkoxyl group (e.g., a 2-hydroxyethoxy group, a 2,3-dihydroxypropoxy group, and a 2-hydroxypropoxy group), a chlorine atom, a fluorine atom, and so forth. Representative examples of the groups represented by $R^{62}$ and $R^{72}$ include a methyl group, an ethyl group, a propyl group, an isopropyl group, a butyl group, an isobutyl group, a hexyl group, a decyl group, an allyl group, a methoxymethyl group, an ethoxymethyl group, a methoxyethyl group, a phenethyl group, a p-chlorophenethyl group, a p-methoxyphenethyl group, a p-carboxyphenethyl group, an o-methylphenethyl group, an o-chloro-p-hydroxyphenethyl group, a p-pyridylmethyl group, a tetrahydrofurfuryl group, a 2-pyranylmethyl group, a 2-tetrahydrothienylmethyl group, a 2-hydroxyethyl group, a 2-hydroxypropyl group, a 2,3-dihydroxypropyl group, a 3-hydroxypropyl group, a carboxymethyl group, a carboxyethyl group, a methoxycarbonylmethyl group, an ethoxycarbonylmethyl group, a 2-(2-hydroxyethoxy)ethyl group, a 2-chloroethyl group, a 2-fluoroethyl group, a sulfoethyl group, and the like.

$R^{63}$ and $R^{73}$ each represents a hydrogen atom, an alkyl group having 4 or less carbon atoms, an alkoxy group having 4 or less carbon atoms, a chlorine atom, or a fluorine atom.

Furthermore, at least one but not all of $R^{61}$ and $R^{62}$, or $R^{71}$ and $R^{72}$ represents a sulfoalkyl group.

Usually, when sensitizing dye represented by formula (VI) or (VII) for the above wavelength region is further used in combination with the sensitizing dyes represented by formula (I), there often occurs a reduction in sensitivity of the necessary spectral sensitization region of other wavelength region. Even if there are sensitizing dyes not causing the above phenomenon (e.g., monomethinecyanine), the resulting light-sensitive material is seriously stained. Thus, they cannot be applied to a light-sensitive material which is necessary to be freed of stain in the present invention. On the other hand, the sensitizing dyes of the present invention do not cause the above undesirable phenomenon and can have high sensitivity even in the case of high illumination exposure.

Representative examples of the sensitizing dyes of formulae (VI) and (VII) are shown below.

(VI-1)

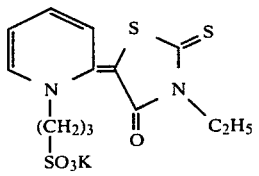

-continued
(VI-2)
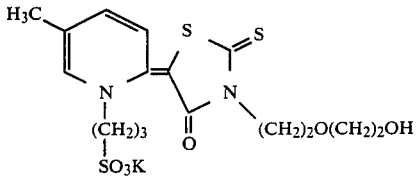
(VI-3)
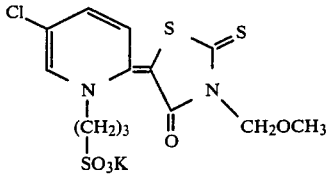
(VI-4)
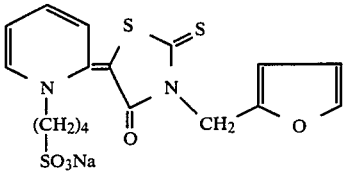
(VI-5)
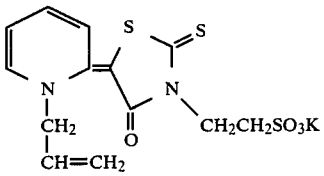
(VI-6)
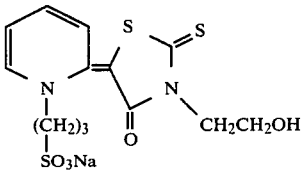
(VI-7)
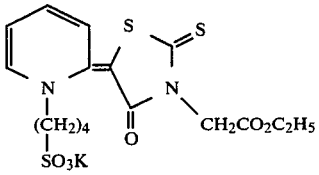
(VI-8)
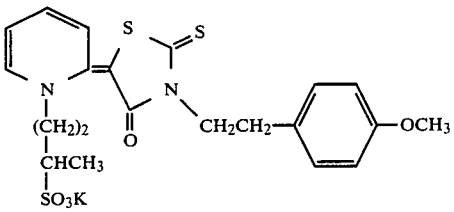
(VII-1)
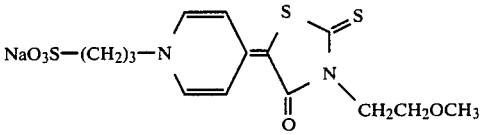
-continued
(VII-2)
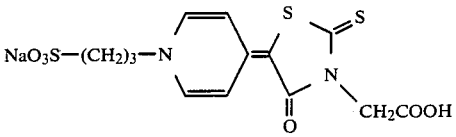
(VII-3)
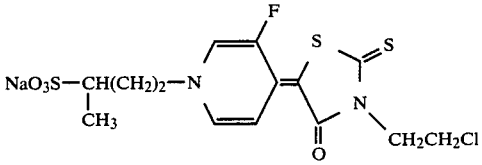
(VII-4)
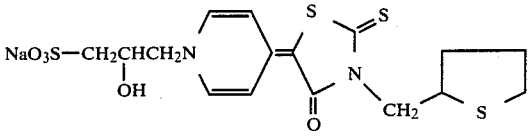
(VII-5)
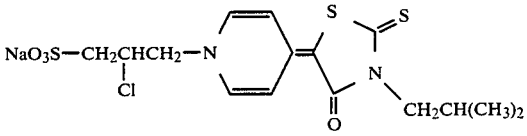
(VII-6)
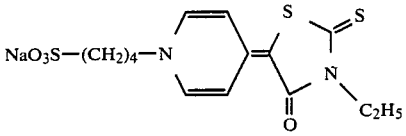
(VII-7)
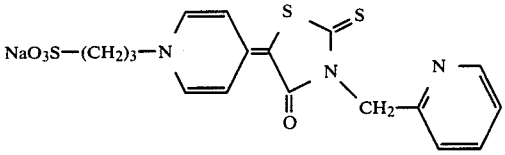
(VII-8)
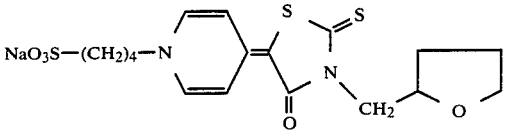
(VII-9)
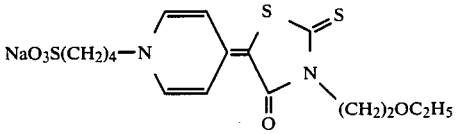
(VII-10)
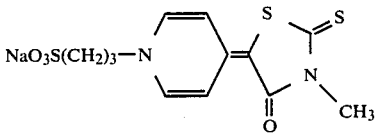

-continued (VII-11)

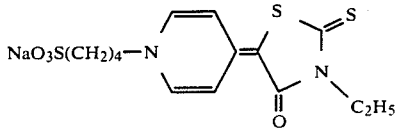

(VII-12)

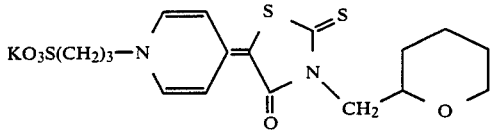

The sensitizing dyes which are represented by formulae (VI) and (VII) are known compounds or analogous to known compounds and can be prepared with reference to, for example, Japanese Patent Publication Nos. 38408/73 and 22370/82; British Patent 1,293,485; Japanese Patent Application (OPI) No. 73137/73; F. M. Hamer, *The Chemistry of Heterocyclic Compounds,* Vol. 18 (i.e., A. Weissberger ed., The Cyanine Dyes and Related Compounds), Interscience, New York (1964); and D. M. Sturmer, *The Chemistry of Heterocyclic Compounds,* Vol. 30, A. Weissberger & E. C. Taylor, eds., John Willey, New York (1977), page 441.

The sensitizing dyes which are represented by formulae (VI) and (VII) can be incorporated in the silver halide emulsion in the same manner as for the above-described sensitizing dyes of formula (I).

With respect to the amount (total) of the sensitizing dye of formulae (VI) and (VII) to be added, it is preferred that they be used in an amount of from about 1/50 to 2 mols per mol of sensitizing dye of formula (I).

The light-sensitive material of the present invention has an advantage that the residual color is very reduced. The reflection light-sensitive material usually shows increased whiteness by using brightening agents. The light-sensitive material of the present invention also shows great reduction in the residual color and thus is very effective as a reflection light-sensitive material. As described above, brightening agents can be used in combination in the light-sensitive material of the present invention. Brightening agents which are able to increase whiteness without adversely affecting the advantages of the present invention include oil-soluble brightening agents such as cumarine-, oxazole-, and thiophene-based brightening agents. It is preferred for these brightening agents to be added in the form of a latex dispersion or emulsification dispersion. As surface active agents to be used for accelerating emulsification and dispersion, the compounds which are represented by formulae (II), (III), (IV) and (V) are preferred for use. Particularly preferred compounds of the above brightening agents are 2,5-bis(benzoxazolyl)thiophene compounds such as 2,5-bis(5,7-di-tert-amylbenzoxazolyl)thiophene, 2,5-bis(5-tert-butylbenzoxazolyl)thiophene, and 2,5-bis(5,7-dioctylbenzoxazolyl)thiophene, and 7-aminocumarine compounds such as 7-[β-(dimethylamino)ethylureido]-3-phenylcumarine and 7-heptanoylamino-3-phenylcumarine.

Silver halide emulsions which are used in the present invention can be prepared by the procedures as described in P. Glafkides, *Chimie et Physique Photographique,* Paul Montel (1967); G. F. Duffin, *Photographic Emulsion Chemistry,* Focal Press (1966); and V. L. Zelikman et al., *Making and Coating Photographic Emulsion,* Focal Press (1964). That is, the silver halide emulsions can be prepared by any suitable methods such as an acid process, a neutral process, and an ammonia process. Silver halide solvents may be used. These silver halide solvents include, as well as ammonia, thioethers and thioureas. Typical examples of such thioethers are described in U.S. Pat. Nos. 3,271,157, 3,790,387 and 3,574,628.

Soluble silver salts and soluble halides can be reacted by methods such as a single jet process, a double jet process, and a combination thereof. In addition, a procedure can be employed in which silver halide grains are formed under the presence of an excess of silver ions (a so-called reverse mixing process). A so-called controlled double jet process can also be employed in which the pAg of the liquid phase wherein the silver halide is formed is kept constant. Two or more silver halide emulsions which have been prepared independently may be used in combination with each other.

Soluble salts are usually removed from the silver halide emulsion after the precipitate formation or physical ripening of the silver halide emulsion. For this purpose, a noodle water-washing method can be employed in which the soluble salts are removed by gelling the emulsions. A flocculation method utilizing inorganic salts containing polyvalent anions, anionic surface active agents, anionic polymers or gelatin derivatives can also be used.

Although so-called primitive emulsions which are not chemically sensitized can be used as the silver halide emulsions, the silver halide emulsions are usually chemically sensitized. This chemical sensitization can be carried out, for example, by the methods as described in H. Frieser ed., *Die Grundlagen der Photographischen Prozesse mit Silverhalogeniden,* Akademische Verlagsgesellschaft, pp. 675–734 (1968).

That is, a sulfur sensitization method using sulfur-containing compounds capable of reacting with active gelatins and silver (e.g., thiosulfates, thioureas, mercapto compounds, and rhodanines), a reduction sensitization method using reducing substances (e.g., stannous salts, amines, hydrazine derivatives, formamidinesulfinic acid, and silane compounds), a noble metal sensitization method using noble metal compounds (e.g., gold complex salts, and metal complex salts of Group VIII metals, such as platinum, iridium, and palladium, of the Periodic Table), and so forth can be used singly or in combination with each other.

The sulfur sensitization method is described in detail, for example, in U.S. Pat. Nos. 1,574,944, 2,410,689, 2,278,947, 2,728,668 and 3,656,955; the reduction sensitization method, in U.S. Pat. Nos. 2,983,609, 2,419,974 and 4,054,458; and the noble metal sensitization method, in U.S. Pat. Nos. 2,399,083, 2,448,060 and British Pat. No. 618,061.

In addition, chemical sensitization may be applied in the presence of thiourea compounds as described in Japanese Patent Application (OPI) No. 29829/80, and also in the presence of nitrogen-containing heterocyclic compounds as described in Japanese Patent Application (OPI) No. 126526/83.

In photographic emulsions which are used in the present invention may be incorporated various compounds for the purpose of, e.g., preventing the formation of fog during the production, storage or photographic processing of the light-sensitive material, or stabilizing photographic performance. That is, many compounds known as antifoggants or stabilizers, such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole), mercaptopyrimidines, mercaptotriazines, thioketo compounds (e.g., oxazolinethione), azaindenes (e.g., triazaindenes, tetraazaindenes (particularly 4-hydroxy-substituted-(1,3,3a,7)tetraazaindenes), and pentaazaindenes), benzenethiosulfonic acid, benzenesulfinic acid, and benzenesulfonic acid amide can be added.

Typical examples of such compounds and a method of using them are described, for example, in U.S. Pat. Nos. 3,954,474, 3,982,947 and Japanese Patent Publication No. 28660/77.

The photographic emulsion layers of the light-sensitive material of the present invention may contain polyalkylene oxide or its derivatives (e.g., ethers, esters and amines), thioether compounds, thiomorpholines, quaternary ammonium salt compounds, urethane derivatives, urea derivatives, imidazole derivatives, 3-pyrazolidones, hydroquinone or its derivatives, and the like for the purpose of increasing sensitivity or contrast, or accelerating development. For example, compounds as described in U.S. Pat. Nos. 2,400,532, 2,423,549, 2,716,062, 3,617,280, 3,772,021, 3,808,003, and British Pat. No. 1,488,991 can be used.

As binders or protective colloids to be used in the emulsion layers and intermediate layer of the light-sensitive material of the present invention, it is advantageous to use gelatins. In addition, other hydrophilic colloids can be used. For example, proteins such as gelatin derivatives, graft polymers of gelatin and other polymers, albumin, and casein, sugar derivatives such as cellulose derivatives (e.g., hydroxyethyl cellulose, carboxymethyl cellulose, and cellulose sulfate), sodium alginate, and starch derivatives, and various synthetic hydrophilic polymeric substances, homopolymers or copolymers, such as polyvinyl alcohol, polyvinyl alcohol partial acetal, poly(N-vinyl)pyrrolidone, polyacrylic acid, polymethacrylic acid, polyacrylamide, polyvinyl imidazole, and polyvinyl pyrazole can be used.

The light-sensitive material of the present invention is particularly effectively used as a black-and-white reflection light-sensitive material which is to be subjected to rapid processing. In addition, it can be used as an X-ray recording light-sensitive material, a photomechanical process light-sensitive material, a light-sensitive material to be used in a facsimile system, etc., and further, as a multilayer, multicolor photographic light-sensitive material having at least two different spectral sensitivities.

The multilayer, multicolor photographic material usually comprises a support, and at least one red-sensitive emulsion layer, at least one green-sensitive emulsion layer and at least one blue-sensitive emulsion layer on the support. The order in which the above layers are arranged can be chosen appropriately. Usually the red-sensitive emulsion layer contains cyan dye forming couplers, the green-sensitive emulsion layer contains magenta dye forming couplers, and the blue-sensitive emulsion layer contains yellow dye forming couplers. In some cases, other combinations can be employed. Even in the case of the multilayer, multicolor photographic material, the effects of the present invention are exhibited significantly in a reflection light-sensitive material.

In the light-sensitive material of the present invention, the hydrophilic colloid layer may contain water-soluble dyes as filter dyes or for various purposes, e.g., preventing irradiation. These dyes include oxonol dyes, hemioxonol dyes, styryl dyes, merocyanine dyes, cyanine dyes and azo dyes. Particularly useful are oxonol dyes, hemioxonol dyes and merocyanine dyes.

In combination with the sensitizing dyes, dyes not having a spectral sensitization action by themselves and exhibiting supersensitization, or substances not substantially absorbing visible light and exhibiting supersensitization may be incorporated in the emulsions. For example, aminostyryl compounds substituted by a nitrogen-containing heterocyclic group (as described, for example, in U.S. Pat. Nos. 2,933,390 and 3,635,721), condensation product of aromatic organic acid and formaldehyde (as described, for example, in U.S. Pat. No. 3,743,510), and cadmium salts may be incorporated.

In the light-sensitive material of the present invention, the photographic emulsion layers or other hydrophilic colloid layers can contain various surface active agents for various purposes of, e.g., preventing charging, improving sliding properties, preventing adhesion. Preferably, the surface active agents can be present in a protective layer, a backing layer, etc.

For example, nonionic surface active agents that can be used include saponin (steroid-based), alkylene oxide derivatives (e.g., polyethylene glycol, condensation product of polyethylene glycol and polypropylene glycol, polyethylene glycol alkyl ethers or alkylaryl ethers, polyethylene glycol esters, polyethylene glycol sorbitan esters, polyalkylene glycol alkylamines or amides, and polyethylene oxide adducts of silicone), glycidol derivatives (e.g., alkenylsuccinic acid polyglyceride and alkylphenol polyglyceride), fatty acid esters of polyhydric alcohols, and alkyl esters of sugar; anionic surface active agents that can be used include those containing an acidic group, such as a carboxyl group, a sulfo group, a phospho group, a sulfate group, and a phosphate group, e.g., alkylcarboxylic acid salts, alkylsulfonic acid salts, alkylbenzenesulfonic acid salts, alkylnaphthalenesulfonic acid salts, alkyl sulfates, alkyl phosphates, N-acyl-N-alkyltaurines, sulfosuccinic acid esters, sulfoalkylpolyoxyethylene alkylphenyl ethers, and polyoxyethylene alkylphosphates; amphoteric surface active agents that can be used include amino acids, aminoalkylsulfonic acids, aminoalkylsulfuric acid or phosphoric acid esters, alkylbetaines, and amine oxides; and cationic surface active agents that can be used include alkylamine salts, aliphatic or aromatic quaternary ammonium salts, heterocyclic quaternary ammonium salts such as pyridinium and imidazolium, and aliphatic or heterocyclic ring-containing phosphonium or sulfonium salts.

These surface active agents are widely used as dispersion aids for dispersions of water-insoluble or sparingly water-soluble polymers (e.g., homo- and copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, and the like, and copolymers of the above monomers and acrylic acid, methacrylic acid, $\alpha,\beta$-unsaturated dicarboxylic acid, hydroxyalkyl acrylate or methacrylate, sulfoalkyl acrylate or methacrylate, styrenesulfonic acid, and the like), which are to be added to the photographic emulsion layers or other hydrophilic colloid layers for the purpose of, e.g., improving dimensional stability, increasing the tone of black images, preventing adhesion, or improving sliding properties.

In the light-sensitive material of the present invention, the photographic emulsion layers or other hydrophilic colloid layers may contain inorganic or organic hardening agents. For example, chromium salts (chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine), and mucohalogenic acids (e.g., mucochloric acid and mucophenoxychloric acid) can be used singly or in combination with each other.

Further additives can be added to the light-sensitive material of the present invention, including brightening agents, spectral sensitizers, desensitizers, matting agents, development accelerators, oils, and image stabilizers.

Representative examples of such further additives and also the above-described ones are described, for example, in *Research Disclosure,* No. 176, pp. 22–31 (RD-17643) (December, 1978).

To silver halide photographic emulsions which are used in the present invention, as protective colloids, in addition to gelatin, acylated gelatins such as phthalated gelatin and malonated gelatin, cellulose compounds such as hydroxyethyl cellulose and carboxymethyl cellulose, soluble starch such as dextrin, hydrophilic polymers such as polyvinyl alcohol, polyvinyl pyrrolidone, and polyacrylamide, plasticizers for dimensional stabilization, latex polymers, and matting agents can be added. The finished emulsion is coated on a suitable support.

Supports which can be used include films of synthetic polymers such as polyalkyl acrylate or methacrylate, polystyrene, polyvinyl chloride, partial formalation polyvinyl alcohol, polycarbonate, polyesters such as polyethylene terephthalate, and polyamides, films of cellulose derivatives such as cellulose nitrate, cellulose acetate, and cellulose acetate butyrate, paper, baryta coated paper, paper covered with α-olefin polymers, for example, and synthetic papers made of polystyrene; that is, any of transparent or opaque support commonly used in photographic elements can be used. The effects of the present invention are obtained more efficiently when reflection supports impermeable to water, such as paper supports coated with olefin polymers such as polystyrene, and synthetic paper supports with white pigments incorporated therein, which are suitable for rapid processing, are employed.

In photographic processing of the layer and light-sensitive material made of the photographic emulsion of the present invention, any of known procedures and processing solutions, as described, for example, in *Research Disclosure,* No. 176, pp. 28–30 (RD-17643)(December, 1978) can be applied. This processing may be a photographic processing (black-and-white photographic processing) to form silver images, or a photographic processing (color photographic processing) to form dye images depending on the purpose. The photographic processing is usually carried out between 18° C. and 50° C. Temperatures lower than 18° C. or temperatures higher than 50° C. can also be employed.

Developers for use in the black-and-white photographic processing can contain known developing agents. For example, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds resulting from the fusion of 1,2,3,4-tetrahydroquinoline rings and indolene rings as described in U.S. Pat. No. 4,067,872 can be used singly or in combination with each other. The developers generally contain other known additives such as preservatives, alkali agents, pH buffers, antifoggants, and, if desired, may further contain dissolving aids, toning agents, development accelerators, surface active agents, defoaming agents, hard water-softening agents, hardening agents, tackifiers, and so forth.

To the photographic emulsions of the present invention, so-called "lith type" developing processing can be applied. This lith type developing processing means a processing in which for photographic reproduction of line images or photographic reproduction of halftone images in terms of dots, dihydroxybenzenes are usually used as the developing agents and the process of development is carried out infectiously in a low sulfite ion concentration (details are described in Mason, *Photographic Processing Chemistry,* pp. 163–165 (1966)).

As a special developing processing, a procedure may be employed in which a light-sensitive material with a developing agent incorporated, for example, in an emulsion layer thereof, is developed with an alkali aqueous solution. Hydrophobic developing agents can be incorporated in the emulsion layer by various procedures, e.g., as described in *Research Disclosure,* No. 169 (RD-16928), U.S. Pat. No. 2,739,890, British Pat. No. 813,253, and West German Pat. No. 1,547,763. This developing processing may be carried out in combination with a silver salt stabilization processing using thiocyanates.

Fixers having commonly used compositions can be employed in the present invention. Fixing agents which can be used include, as well as thiosulfates and thiocyanates, organic sulfur compounds known effective as fixing agents. These fixers may contain water-soluble aluminum salts as hardening agents.

The light-sensitive material of the present invention is preferably processed by the use of an automatic developing machine, and therefore rapid processing, for example, can be applied. In this photographic processing, it is preferred that the developing step be carried out at 30° to 45° C. for 5 to 60 seconds, the fixing step, at 30° to 45° C. for 5 to 30 seconds, and the washing step, at 30° to 45° C. for 5 to 30 seconds. In this case, as a fixing bath, it is preferred to use an acidic hardening fixing bath containing polyvalent metals.

In the case of light-sensitive materials with a reflection support, any stain present after photographic processing is very conspicuous; in particular, when a processing solution containing a hardening agent is applied, the residual color of the sensitizing dye is generally undesirably large. On the other hand, the light-sensitive material of the present invention is greatly reduced in stain when such a processing solution is applied and is superior in whiteness. Thus, it can be said that the light-sensitive material of the present invention can be processed more effectively with the fixing solution containing a hardening agent than the conventional light-sensitive materials.

Exposure to form photographic images is carried out by conventional procedures. That is, any of known light sources containing an infrared light such as natural light (sunlight), a tungsten lamp, a fluorescent lamp, a mercury lamp, a xenon arc lamp, a carbon arc lamp, a xenon flash lamp, a cathode ray tube flying spot, a luminescent semiconductor diode, and a laser light (e.g., a gas laser, a dye laser, and a semiconductor layer) can be used. In addition, the light-sensitive material of the present invention may be exposed to light emitted from a fluorescent substance stimulated by electron rays, X-rays, $\gamma$-rays, or $\alpha$-rays, for example. The exposure time may be, of course, from 1/1,000 to 1 second, which is usually employed for cameras, or even shorter than 1/1,000 second, such as from $1/10^4$ to $1/10^6$ second in cases wherein a xenon flash lamp and a cathode ray tube are used, or longer than 1 second. If desired, the spectral composition of light for the exposure can be controlled by means of a color filter. In the light-sensitive material of the present invention, high sensitivity can be obtained, of course, by the exposure for an exposure time longer than 1/1,000 second, and also by the so-called flash exposure in which the exposure time is between $1/10^4$ and $1/10^6$ second. The light-sensitive material of the present invention, therefore, has superior performance for flash exposure.

The present invention is described in greater detail with reference to the following examples, although it is not intended to be limited thereto.

EXAMPLE 1

A 1N aqueous solution of silver nitrate and an aqueous solution containing 0.988 mol of potassium bromide and 0.012 mol of potassium iodide were mixed by the double jet process while controlling the pAg to prepare a silver iodobromide emulsion. This emulsion was washed with water and, thereafter, was subjected to gold sensitization and sulfur sensitization so that the optimum sensitivity could be obtained. Grains of the silver iodobromide emulsion had an average grain diameter of 0.6 $\mu$m and were tetradecahedral grains in which the proportion of (100) faces was 86%. This emulsion is referred to as "Emulsion A".

A comparative silver iodobromide emulsion was prepared in the same manner as above except that the pAg was changed. In this emulsion, the grains had an average grain diameter of 0.6 $\mu$m and were tetradecahedral grains in which the proportion of (100) faces was 32%. This emulsion is referred to as "Emulsion B".

To 30 g of each emulsion were added a sensitizing dye of formula (I), a surface active agent of formula (II), (III), (IV) or (V), or a comparative compound as shown in Tables 1 and 2. In addition, a 0.02% solution of 5-mercapto-1-phenyltetrazole, a 2% solution of sodium 2-hydroxy-4,6-dichlorotriazine, a 10% gelatin gel, and water were added to prepare an aqueous solution in which the total amount was 120 g and the amounts of silver and gelatin were 3.12 g and 5.4 g, respectively.

Independently, an aqueous solution composed mainly of gelatin was prepared.

The above emulsion-containing solution and the gelatin-containing solution were coated on a support simultaneously in such a manner that the resulting emulsion layer was sandwiched between the support and the gelatin layer, and, furthermore, that the amount of gelatin in the gelatin layer was 1.5 g/m$^2$ and that in the emulsion layer was 2.25 g/m$^2$, thereby producing a photographic light-sensitive material.

Each light-sensitive material was exposed wedgewise for $1\times10^{-2}$ second with a 3,200 lux lamp having a color temperature of 2,854° K., or for $1\times10^{-6}$ second with a xenon lamp.

After exposure, the light-sensitive material was developed at 30° C. for 20 seconds with a developer having the formulation as shown below, stopped, fixed, and then washed with water to obtain a strip with a black-and-white image. This strip was measured for density to determine white light sensitivity and fog. The optical density at the base used in the determination of the sensitivity was fog+0.50.

| | |
|---|---|
| Composition of Developer | |
| 1-Phenyl-3-pyrazolidone | 0.4 g |
| Sodium Sulfite | 67.0 g |
| Hydroquinone | 23.0 g |
| Potassium Hydroxide | 11.0 g |
| Sodium Carbonate.Monohydrate | 11.0 g |
| Potassium Bromide | 3.0 g |
| 5-Methylbenzotriazole | 133 ml |
| Water to make | 1 liter |
| Composition of Fixer | |
| Ammonium Thiosulfate | 170.0 g |
| Sodium Sulfite (anhydrous) | 15.0 g |
| Boric Acid | 7.0 g |
| Glacial Acetic Acid | 15.0 ml |
| Potash Alum | 20.0 g |
| Ethylenediaminetetracetic Acid | 0.1 g |
| Tartaric Acid | 3.5 g |
| Water to make | 1 liter |

The above light-sensitive materials were each, without application of exposure, developed with the same developer as used above at 20° C. for 20 seconds, stopped at 20° C. for 2 seconds, fixed with the same fixer as used above at 20° C. for 20 seconds, and then washed with water at 16.5° C. for 20 seconds. The thus-processed light-sensitive materials were used to determine their stain and whiteness. In determining the stain (residual color), the absorbance at $\nu$max of the residual sensitizing dye was measured by the reflection measuring method by the use of a color analyzer (Model 607, manufactured by Hitachi Seisakusho Co., Ltd.).

The comparative compounds not falling within the scope of the present invention used in this example are shown below.

(a)

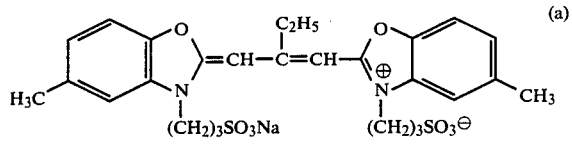

(b)

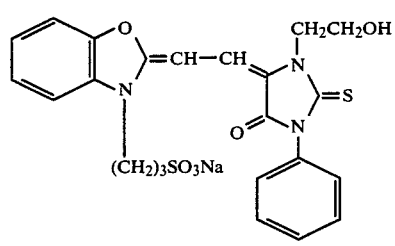

-continued (c)

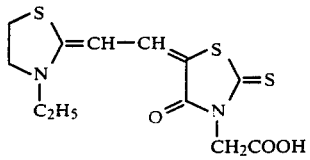

(d)

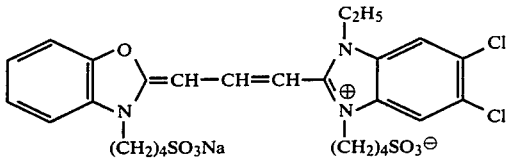

(e)

-continued $C_{14}H_{29}OSO_3Na$ (f)

$C_{19}H_{39}CON(CH_2)_4SO_3Na$ (g)

(h)

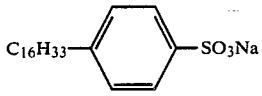

(i)

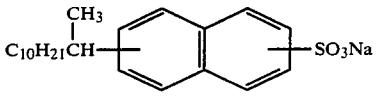

TABLE 1

| Run No. | Compound Added (× $10^{-4}$ mol/mol silver) | Compound Added (g/mol silver) | Emulsion | Sensitivity $10^{-2}$ Sec. Exposure | Sensitivity $10^{-6}$ Sec. Exposure | Fog | Stain (residual color) Absorbance | Remarks |
|---|---|---|---|---|---|---|---|---|
| 1-1 | (c) 1.38 | (II-10) 3.54 | A | 83 | 85 | 0.12 | 0.033 | ** |
| 1-2 | (c) 2.07 | (II-10) 3.54 | A | 100 (base) | 100 (base) | 0.12 | 0.040 | ** |
| 1-3 | (c) 3.11 | (II-10) 3.54 | A | 91 | 93 | 0.11 | 0.048 | ** |
| 1-4 | (I-1) 1.38 | (II-10) 3.54 | A | 105 | 95 | 0.11 | 0.051 | * |
| 1-5 | (I-1) 2.07 | (II-10) 3.54 | A | 128 | 115 | 0.11 | 0.066 | * |
| 1-6 | (I-1) 2.76 | (II-10) 3.54 | A | 150 | 126 | 0.12 | 0.084 | * |
| 1-7 | (I-1) 1.38 | (III-1) 3.54 | A | 106 | 98 | 0.11 | 0.049 | * |
| 1-8 | (I-1) 2.07 | (III-1) 3.54 | A | 127 | 114 | 0.11 | 0.063 | * |
| 1-9 | (I-1) 2.76 | (III-1) 3.54 | A | 149 | 128 | 0.12 | 0.080 | * |
| 1-10 | (I-3) 1.38 | (III-3) 3.54 | A | 153 | 124 | 0.11 | 0.050 | * |
| 1-11 | (I-3) 2.07 | (III-3) 3.54 | A | 172 | 140 | 0.11 | 0.065 | * |
| 1-12 | (I-3) 2.76 | (III-3) 3.54 | A | 193 | 156 | 0.11 | 0.082 | * |
| 1-13 | (I-8) 1.38 | (IV-1) 3.54 | A | 151 | 123 | 0.11 | 0.048 | * |
| 1-14 | (I-8) 2.07 | (IV-1) 3.54 | A | 182 | 141 | 0.11 | 0.063 | * |
| 1-15 | (I-8) 2.76 | (IV-1) 3.54 | A | 204 | 155 | 0.11 | 0.081 | * |
| 1-16 | (I-10) 1.38 | (V-6) 3.54 | A | 134 | 118 | 0.11 | 0.048 | * |
| 1-17 | (I-10) 2.07 | (V-6) 3.54 | A | 161 | 130 | 0.11 | 0.061 | * |
| 1-18 | (I-10) 2.76 | (V-6) 3.54 | A | 182 | 143 | 0.12 | 0.079 | * |
| 1-19 | (I-1) 2.07 | (f) 3.54 | A | 108 | 97 | 0.15 | 0.122 | ** |
| 1-20 | (I-1) 2.07 | (g) 3.54 | A | 118 | 106 | 0.14 | 0.108 | ** |
| 1-21 | (I-1) 2.07 | (i) 3.54 | A | 85 | 76 | 0.16 | 0.127 | ** |
| 1-22 | (I-3) 2.07 | (f) 3.54 | A | 151 | 122 | 0.14 | 0.107 | ** |
| 1-23 | (I-3) 2.07 | (h) 3.54 | A | 143 | 116 | 0.14 | 0.112 | ** |
| 1-24 | (I-3) 2.07 | (i) 3.54 | A | 127 | 104 | 0.16 | 0.123 | ** |
| 1-25 | (I-1) 1.38 | (III-1) 3.54 | B | 99 | 89 | 0.12 | 0.057 | ** |
| 1-26 | (I-1) 2.07 | (III-1) 3.54 | B | 118 | 106 | 0.12 | 0.074 | ** |
| 1-27 | (I-1) 2.76 | (III-1) 3.54 | B | 124 | 106 | 0.12 | 0.096 | ** |
| 1-28 | (I-3) 1.38 | (III-3) 3.54 | B | 122 | 100 | 0.12 | 0.063 | ** |
| 1-29 | (I-3) 2.07 | (III-3) 3.54 | B | 138 | 112 | 0.13 | 0.085 | ** |
| 1-30 | (I-3) 2.07 | (III-3) 3.54 | B | 154 | 125 | 0.14 | 0.098 | ** |
| 1-40 | (c) 2.07 | (II-10) 3.54 | B | 105 | 102 | 0.12 | 0.039 | ** |

Note
*Examples within the scope of the preset invention.
**Comparative examples not falling within the scope of the present invention.

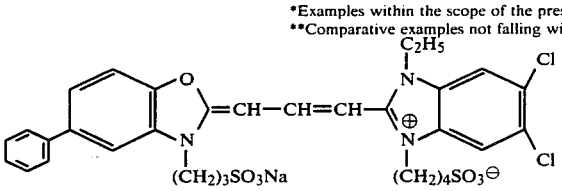

TABLE 2

| Run No. | Compound Added (× $10^{-4}$ mol/mol silver) | | Compound Added (g/mol silver) | | Sensitivity $10^{-2}$ Sec. Exposure | Sensitivity $10^{-6}$ Sec. Exposure | Fog | Stain (residual color) Absorbance | Remarks |
|---|---|---|---|---|---|---|---|---|---|
| 2-1 | (c) | 2.07 | (II-10) | 3.54 | 100 (base) | 100 (base) | 0.12 | 0.040 | Although the absorbance is low, the pink stain is conspicuous. |
| 2-2 | " | 2.07 | (III-3) | " | 101 | 100 | 0.12 | 0.041 | |
| 2-3 | " | 2.07 | (f) | " | 101 | 101 | 0.12 | 0.040 | |
| 2-4 | (b) | 1.38 | (II-10) | " | 89 | 79 | 0.15 | 0.053 | |
| 2-5 | " | 2.07 | " | " | 87 | 81 | 0.16 | 0.063 | |
| 2-6 | " | 3.11 | " | " | 81 | 71 | 0.15 | 0.074 | |
| 2-7 | (a) | 1.38 | " | " | 45 | 72 | 0.11 | 0.051 | |

TABLE 2-continued

| Run No. | Compound Added (× $10^{-4}$ mol/mol silver) | | (g/mol silver) | | Sensitivity $10^{-2}$ Sec. Exposure | Sensitivity $10^{-6}$ Sec. Exposure | Fog | Stain (residual color) Absorbance | Remarks |
|---|---|---|---|---|---|---|---|---|---|
| 2-8 | " | 2.07 | " | " | 62 | 87 | 0.11 | 0.067 | |
| 2-9 | " | 3.11 | " | " | 71 | 93 | 0.12 | 0.080 | |
| 2-10 | (d) | 1.38 | " | " | 41 | 42 | 0.12 | 0.061 | |
| 2-11 | " | 2.07 | " | " | 50 | 63 | 0.13 | 0.082 | |
| 2-12 | " | 3.11 | " | " | 53 | 62 | 0.14 | 0.091 | |
| 2-13 | (e) | 1.38 | " | " | 112 | 126 | 0.17 | 0.108 | |
| 2-14 | " | 2.07 | " | " | 158 | 177 | 0.23 | 0.126 | |
| 2-15 | " | 3.11 | " | " | 174 | 199 | 0.28 | 0.134 | |
| 2-16 | " | 2.07 | (II-9) | " | 156 | 173 | 0.23 | 0.124 | |
| 2-17 | " | 2.07 | (III-1) | " | 159 | 176 | 0.22 | 0.126 | |
| 2-18 | " | 2.07 | (f) | " | 150 | 169 | 0.22 | 0.126 | |
| 2-19 | " | 2.07 | (i) | " | 148 | 167 | 0.31 | 0.132 | |

Note:
In the samples of Table 2, Emulsion A was used.

It can be seen from Tables 1 and 2 that the light-sensitive materials of the present invention are superior in both sensitivity and residual color. In connection with the residual color, it is preferred that the values in the tables be 0.09 or less. If the value is in excess of 0.09, the degree of residual color can be evaluated by careful examination, and thus such a light-sensitive material is unmarketable. If it is more than 0.1, the residual color is regarded to be seriously conspicuous.

The sensitizing dyes (a) to (e) have a spectral sensitization distribution within almost the same wavelength regions as for the sensitizing dyes of formula (I) of the present invention, and the surface active agents (f) to (i) used as comparative compounds are well known compounds that have been used in preparation of photographic light-sensitive materials and are not particular compounds. If surface active agents not falling within the scope of the present invention are used, the residual color is considerably increased and a reduction in sensitivity results.

When Emulsion B not falling within the scope of the present invention, in which the proportion of (100) faces is not more than 50%, is used, an increase in residual color and a reduction in sensitivity result, although not to the extent that the surface active agents exert (these adverse influences are not observed in the case of the sensitizing dye (c) not falling within the scope of the present invention).

It can also be seen from Tables 1 and 2 that in some combinations not falling within the scope of the present invention, the residual color is reduced, but in all the combinations the sensitivity is inferior to that in the present invention; conversely, in cases wherein the sensitivity is equal to that in the present invention, the residual color is significant. It is necessary for marketable light-sensitive materials to be superior in both the sensitivity and residual color. Thus, it can be seen that both the sensitivity and residual color are satisfied only when the limited combinations according to the present invention are used.

EXAMPLE 2

The procedure of Example 1 was repeated wherein the surface active agents of formulae (II) to (V) were added not to the emulsion-containing solution, but rather to the gelatin-containing solution. The thus-produced light-sensitive materials were processed in the same manner as in Example 1, and the results set forth in Table 3 were obtained.

TABLE 3

| Run No. | Compound Added (× $10^{-4}$ mol/mol silver) | | (g/mol silver) | | Emulsion | Sensitivity $10^{-2}$ Sec. Exposure | Sensitivity $10^{-6}$ Sec. Exposure | Fog | Stain (residual color) Absorbance | Remarks |
|---|---|---|---|---|---|---|---|---|---|---|
| 1-2 | (e) | 2.07 | (II-10) | 3.54 | A | 100 (base) | 100 (base) | 0.12 | 0.040 | Comparison |
| 3-1 | (I-12) | 1.38 | (III-5) | " | A | 148 | 124 | 0.11 | 0.046 | Invention |
| 3-2 | " | 2.07 | " | " | A | 170 | 139 | 0.11 | 0.059 | " |
| 3-3 | " | 2.76 | " | " | A | 189 | 155 | 0.11 | 0.078 | " |
| 3-4 | " | 2.07 | (II-13) | " | A | 175 | 144 | 0.11 | 0.57 | " |
| 3-5 | " | 2.07 | (f) | " | A | 136 | 110 | 0.12 | 0.82 | Comparison |
| 3-6 | " | 2.07 | (i) | " | A | 132 | 108 | 0.13 | 0.84 | " |
| 3-7 | " | 2.07 | (III-5) | " | B | 153 | 126 | 0.11 | 0.86 | " |
| 3-9 | (e) | 1.38 | " | " | A | 108 | 119 | 0.17 | 0.105 | " |
| 3-10 | " | 2.07 | " | " | A | 151 | 166 | 0.22 | 0.123 | " |
| 3-11 | " | 3.11 | " | " | A | 167 | 187 | 0.27 | 0.132 | " |
| 3-12 | " | 2.07 | (f) | " | A | 153 | 174 | 0.24 | 0.126 | " |
| 3-13 | (d) | 1.38 | (III-5) | " | A | 46 | 46 | 0.12 | 0.060 | " |
| 3-14 | " | 2.07 | " | " | A | 55 | 69 | 0.13 | 0.080 | " |
| 3-15 | " | 3.11 | " | " | A | 57 | 68 | 0.14 | 0.089 | " |
| 3-16 | " | 2.07 | (i) | " | A | 49 | 61 | 0.14 | 0.093 | " |

It can be seen from Table 3 that basically the same results as in Example 1 can be obtained even if the surface active agents of formulae (II) to (V) or their comparative compounds are added directly not to the emulsion layer; that is, the combinations of the present invention are also effective even if added by the above procedure.

EXAMPLE 3

The procedure of Example 1 was repeated wherein the sensitizing dye (I) was added in combination with the sensitizing dye (VI) or (VII), and the results set forth in Table 4 were obtained.

TABLE 4

| Run No. | Compound Added ($\times 10^{-4}$ mol/mol silver) | | Compound Added ($\times 10^{-4}$ mol/mol silver) | | Sensitivity $10^{-2}$ Sec. Exposure | Sensitivity $10^{-6}$ Sec. Exposure | Fog | Stain (residual color) Absorbance |
|---|---|---|---|---|---|---|---|---|
| 4-1 | (I-3) | 1.38 | | | 100 (base) | 100 (base) | 0.11 | 0.046 |
| 4-2 | " | 2.07 | | | 112 | 113 | 0.11 | 0.069 |
| 4-3 | " | 3.11 | | | 126 | 126 | 0.11 | 0.073 |
| 4-4 | " | 2.07 | (VI-1) | 1.5 | 140 | 159 | 0.11 | 0.047 |
| 4-5 | " | 2.07 | " | 2.07 | 125 | 141 | 0.11 | 0.061 |
| 4-6 | " | 2.07 | (VII-11) | 1.5 | 145 | 168 | 0.11 | 0.066 |
| 4-7 | (I-10) | 2.07 | | | 91 | 95 | 0.11 | 0.048 |
| 4-8 | " | 2.07 | | | 105 | 105 | 0.11 | 0.062 |
| 4-9 | " | 3.11 | | | 119 | 115 | 0.12 | 0.078 |
| 4-10 | " | 2.07 | (VII-9) | 1.50 | 126 | 143 | 0.11 | 0.062 |
| 4-11 | " | 2.07 | " | 2.07 | 117 | 121 | 0.11 | 0.064 |
| 4-12 | " | 2.07 | (VII-8) | 1.50 | 125 | 138 | 0.11 | 0.063 |

Note:
In all the cases, the emulsion used was Emulsion A, and, as the compound of formula (II), Compound (II-10) was added in an amount of 3.54 g/mol silver.

It can be seen from Table 4 that the combinations of the present invention provide increased sensitivity with almost no increase in stain.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support and at least one silver halide emulsion layer on the support, containing at least one sensitizing dye represented by formula (I)

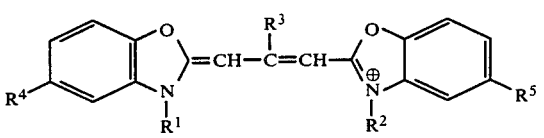

(I)

wherein $R^1$ and $R^2$ each represents a lower alkyl group substituted by a sulfo group, a carboxy group, or a hydroxyl group, provided that at least one of $R^1$ and $R^2$ represents a sulfoalkyl group; $R^3$ represents a hydrogen atom, a lower alkyl group, or a substituted or unsubstituted phenethyl group; $R^4$ represents a chlorine atom, a methoxy group, an ethoxy group, or a hydrogen atom; $R^5$ represents a chlorine atom, a phenyl group, a lower alkoxy group, or a lower alkyl group;

wherein at least one of the silver halide emulsion layer and other hydrophilic colloid layers contains at least one compound represented by formula (II), (III), (IV), or (V)

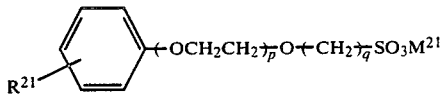

(II)

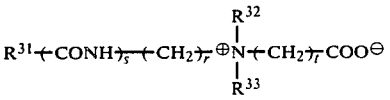

(III)

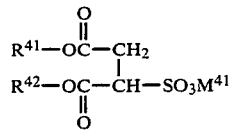

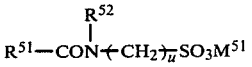

(V)

wherein $R^{21}$ represents an alkyl or alkenyl group having from 4 to 16 carbon atoms; $R^{31}$ and $R^{51}$ each represents an alkyl or alkenyl group having from 5 to 17 carbon atoms; $R^{32}$ and $R^{33}$ each represents an alkyl group having 4 or less carbon atoms, or a hydroxyalkyl group, provided that the total number of carbon atoms of $R^{32}$ and $R^{33}$ is 5 or less; $R^{41}$ and $R^{42}$ each represents an alkyl or alkenyl group having from 4 to 12 carbon atoms, provided that the total number of carbon atoms in $R^{41}$ and $R^{42}$ is 18 or less; $R^{51}$ represents an alkyl or alkenyl group having from 5 to 17 carbon atoms; $R^{52}$ represents a methyl group, an ethyl group, or a propyl group; p is an integer of from 1 to 11; q is 2, 3, or 4; r is an integer of from 2 to 8; s is 0 or 1; t is 1, 2, or 3; u is 2, 3, or 4; and $M^{21}$, $M^{42}$ and $M^{51}$ each represents a hydrogen atom or an alkali metal atom;

and the silver halide grains contained in the silver halide emulsion are substantially tetradecahedral grains in which the proportion of (100) faces is at least 50%.

2. A silver halide photographic light-sensitive material as in claim 1, wherein the support is a water-impermeable reflection support.

3. A silver halide photographic light-sensitive material as in claim 1, wherein said light-sensitive material is a black-and-white reflection light-sensitive material.

4. A silver halide photographic light-sensitive material as in claim 1, wherein the silver halide emulsion contains at least one sensitizing dye represented by formula (VI) or (VII)

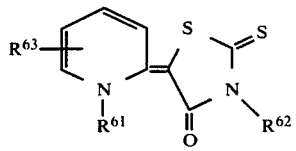

(VI)

-continued (VII)

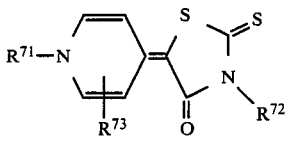

wherein $R^{61}$ and $R^{71}$ each represents an alkyl group having 6 or less carbon atoms, an alkenyl group, or a sulfoalkyl group (wherein the sulfo group may form a salt); $R^{62}$ and $R^{72}$ each represents a lower alkyl or alkenyl group which may be substituted; and $R^{63}$ and $R^{73}$ each represents a hydrogen atom, an alkyl group having 4 or less carbon atoms, an alkoxyl group having 4 or less carbon atoms, a chlorine atom, or a fluorine atom, provided that at least one but not all of $R^{61}$ and $R^{62}$, or $R^{71}$ and $R^{72}$ represents a sulfoalkyl group.

5. A silver halide photographic light-sensitive material as in claim 2, which is processed with a fixing solution containing a polyvalent metal chloride and accompanied by hardening.

6. A silver halide photographic light-sensitive material as in claim 4, wherein the support is a water-impermeable reflection support.

7. A silver halide photographic light-sensitive material as in claim 1, wherein the sensitizing dye of formula (I) is used in an amount of from about $2\times10^{-6}$ to $8\times10^{-3}$ mol per mol of silver halide in the silver halide emulsion, the amount of silver halide emulsion in the silver halide emulsion layer is 2.0 g/m$^2$ or less calculated as silver, and the proportion of (100) faces is from 50 to 95%.

8. A silver halide photographic light-sensitive material as in claim 4, wherein the amount of the sensitizing dye of formulae (VI) and (VII) is from about 1/50 to 2 mols per mol of sensitizing dye of formula (I).

9. A silver halide photographic light-sensitive material as in claim 1, wherein $R^1$ and $R^2$ both represent unsubstituted or substituted sulfoalkyl groups having from 2 to 4 carbon atoms; $R^3$ represents a methyl group, an ethyl group, or a propyl group; $R^4$ represents a methoxy group, an ethoxy group, or a chlorine atom; and $R^5$ represents a chlorine atom, a phenyl group, a methoxy group, or an ethoxy group.

10. A method for processing a silver halide photographic light-sensitive material which comprises processing the silver halide light-sensitive material as in claim 5 with a fixing solution containing a polyvalent metal chloride.

* * * * *